US008099887B2

(12) United States Patent
McCoy et al.

(10) Patent No.: US 8,099,887 B2
(45) Date of Patent: Jan. 24, 2012

(54) ORBITAL SIGN ASSEMBLY

(76) Inventors: Vance Joseph Alan McCoy, Atlanta, GA (US); Alexis Ivan Wertelecki, Atlanta, GA (US)

( * ) Notice: Subject to any disclaimer, the term of this patent is extended or adjusted under 35 U.S.C. 154(b) by 199 days.

(21) Appl. No.: 12/062,180

(22) Filed: Apr. 3, 2008

(65) Prior Publication Data

US 2009/0249667 A1 Oct. 8, 2009

(51) Int. Cl.
*G09F 7/22* (2006.01)

(52) U.S. Cl. ..... 40/617; 248/317

(58) Field of Classification Search ..... 40/617, 40/757; 116/63 R, DIG. 33; 248/317, 324; 403/165, 192, 194, 196; 362/391; 16/87 R
See application file for complete search history.

(56) References Cited

U.S. PATENT DOCUMENTS 1,708,336 A * 4/1929 Stephenson ..... 40/617
2,304,743 A * 12/1942 Schott ..... 40/617
2,956,768 A * 10/1960 Livingston ..... 248/324
3,126,575 A * 3/1964 Schoeneberg ..... 16/87 R
3,484,973 A * 12/1969 Evenson et al. ..... 40/617
3,691,677 A * 9/1972 Blaising ..... 40/617
3,916,265 A * 10/1975 Friedman ..... 361/641
4,089,129 A * 5/1978 Patterson, Jr. ..... 40/617
4,520,984 A * 6/1985 Rouleau ..... 248/489
4,646,997 A * 3/1987 Fadley ..... 248/201
5,533,464 A * 7/1996 Todd ..... 116/174
6,327,803 B1 * 12/2001 Ruderman ..... 40/601
6,367,750 B1 * 4/2002 Ford ..... 248/208
2003/0234114 A1 * 12/2003 Sutehall et al. ..... 174/40 R
2004/0163295 A1 * 8/2004 Fontana et al. ..... 40/617

* cited by examiner

*Primary Examiner* — Joanne Silbermann
*Assistant Examiner* — Christopher E Veraa
(74) *Attorney, Agent, or Firm* — Gardner Groff Greenwald & Villanueva, PC

(57) ABSTRACT

One embodiment of an orbital sign assembly, allowing for attachment to and full pivot or orbit capability of the attached signage around a horizontal run of span wire or other support member. Any one traffic signage is supported from a horizontal run of a span wire or other support member by a orbital sign assembly comprising a sign bracket (10) with attachment points at opposing ends and center, a pivot attachment (2) allowing 360 degree pivoting of the sign, which adjoins the sign bracket (10) to the a cable saddle (1) which contains two pivot attachment rails (3) for limiting side to side movement of the pivot attachment on its track. Conventional U-bolts (5) are located within the cable saddle and are used to clamp down to the span wire while still allowing traffic signal cables to be inserted through a cable slot (4) within the cable saddle (1). A cant tilt slot (11) is located on the sign bracket for leveling signage.

19 Claims, 4 Drawing Sheets

ORBITAL SIGN ASSEMBLY

CROSS REFERENCE TO RELATED APPLICATION

N/A

FEDERALLY SPONSORED RESEARCH

N/A

SEQUENCE LISTING OR PROGRAM

N/A

BACKGROUND OF THE INVENTION

1. Field of Invention

This invention relates to hangers, specifically to an improved traffic signage/device hanger to be used mainly in conjunction with a support member such as a span wire.

2. Discussion of Prior Art

One of the oldest sign hangers (that is still in use) uses a bracket that fastens to a support member or span wire through the use of two cable clamps. Two vertical slots are cut into this bracket through which two bolts are inserted and fastened to a long thin piece of flat bar steel. The traffic sign is attached to this flat bar steel through the use of additional bolts. The purpose of the two vertical slots and the bracket is to allow for the traffic sign to be adjusted for cant tilt (since the span wire may not be level). The disadvantage to this system is that when the wind blows, it transfers torque directly to the span wire since it is rigidly attached. This will eventually result in damage, loosening, and unbundling of associated electrical, traffic signal cables and vehicle detection cables. In a worst case scenario, the span wire can break causing all of the attached traffic signals and signage to fall onto the roadway.

The next type of sign hanger in use has the advantage over the previous in that it allows the sign to pivot in a forward and backward motion for a total of 180 degrees, but the ability to cant tilt is eliminated. This 180 degree range of motion reduces torque applied to the span wire however it does not completely eliminate it. Again because this hanger like the previously mentioned one is rigidly attached directly to the span wire, torque is still applied when the sign moves. The ability to adjust the facing direction of the sign was added in this design. This allowed the sign to be positioned on a horizontal axis in a multitude of angles to accommodate for the angle of approach and direction of the street. Still this system like the first does not prevent unbundling and damage to cables, which can lead to costly and dangerous repairs.

The most modern sign hanger combines all the advantages of the previously mentioned hangers. Yet, again because it is rigidly attached to the span wire and only able to pivot 180 degrees, in extreme weather conditions the sign can flip over and twist causing damage to the span wire and cables.

Accordingly several objects and advantages of the invention are:

(a) greatly improving upon the pivoting or rotation ability of the sign hanger about the span wire by using a circular shaped clamp or attachment that orbits about, allowing the sign bracket and attached signage to rotate a full 360 degrees in either direction.

(b) use of a bearing or chassis which allows electrical, traffic signal cables and vehicle detection cables to pass through untouched and unharmed by the rotation of the sign hanger about the span wire or other support member.

(c) improving cant tilt by use of a semi circle shaped hole or slot to allow for angular adjustment to level the physical sign when the hanger is hung on an unlevel span wire.

(d) eliminates or greatly reduces torque applied to the span wire thereby reducing and/or preventing costly repairs.

(e) allowing free motion of the sign bracket and sign under high wind conditions like those found during hurricanes and tornadoes reducing possibility of all or part of sign assembly breaking away.

SUMMARY

In accordance with the present invention an orbital sign assembly comprises mainly a cable saddle which attaches to a span wire or support member and acts as a bearing or chassis for the pivot attachment to rotate or pivot about, a pivot attachment that rotates or orbits about the cable saddle, and a sign bracket for attachment of various signage. The pivot attachment joins the cable saddle with the sign bracket.

DRAWINGS

Figures

In certain figures closely related parts have the same number but different alphabetic suffixes.

DRAWINGS

Reference Numerals

| | |
|---|---|
| 1 cable saddle | 2 pivot attachment |
| 3 pivot attachment rails | 4 cable slot |
| 5 U-bolt | 6 bolt |
| 7 saddle washer | 8 washer nut |
| 9 lock nut | 10 sign bracket |
| 11 cant tilt slot | |

DETAILED DESCRIPTION

Figure 1:
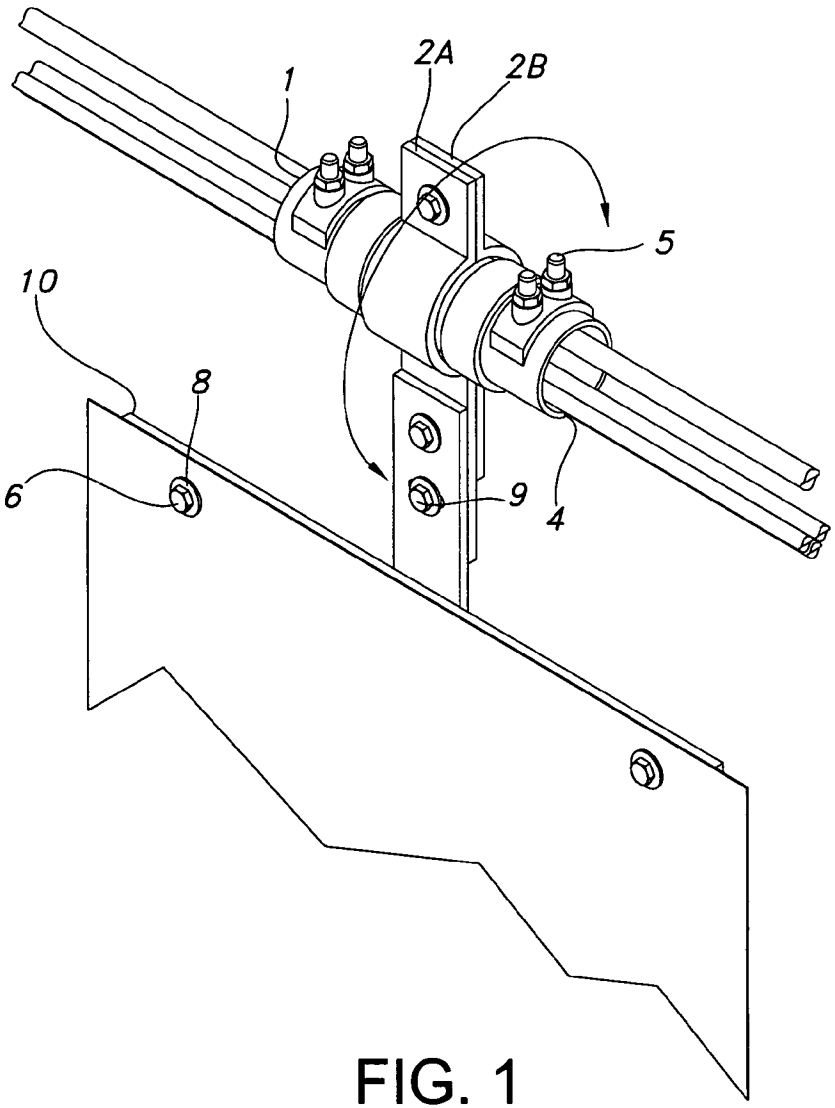
FIG. 1 is an isometric view of the preferred embodiment of the present invention showing a span wire and two other (utility) cables crossing through and its orbital capability.

FIG. 1 shows a perspective view of the preferred embodiment of the orbital sign assembly. The orbital sign assembly includes mainly a cable saddle 1, a pivot attachment 2, and a sign bracket 10. The cable saddle is cylindrical in shape and acts as a bearing or chassis to which the pivot attachment attaches. The pivot attachment 2 is comprised of two pieces 2*a* and 2*b* which are joined together at top and bottom. The pivot attachment 2 has two semicircle sections that when joined form a circular opening that allows for the cable saddle 1 to be enclosed about. The pivot attachment 2 has two ends.

At one end there is the above mentioned circular opening and at the other an attachment point for the sign bracket 10.

Figure 2:
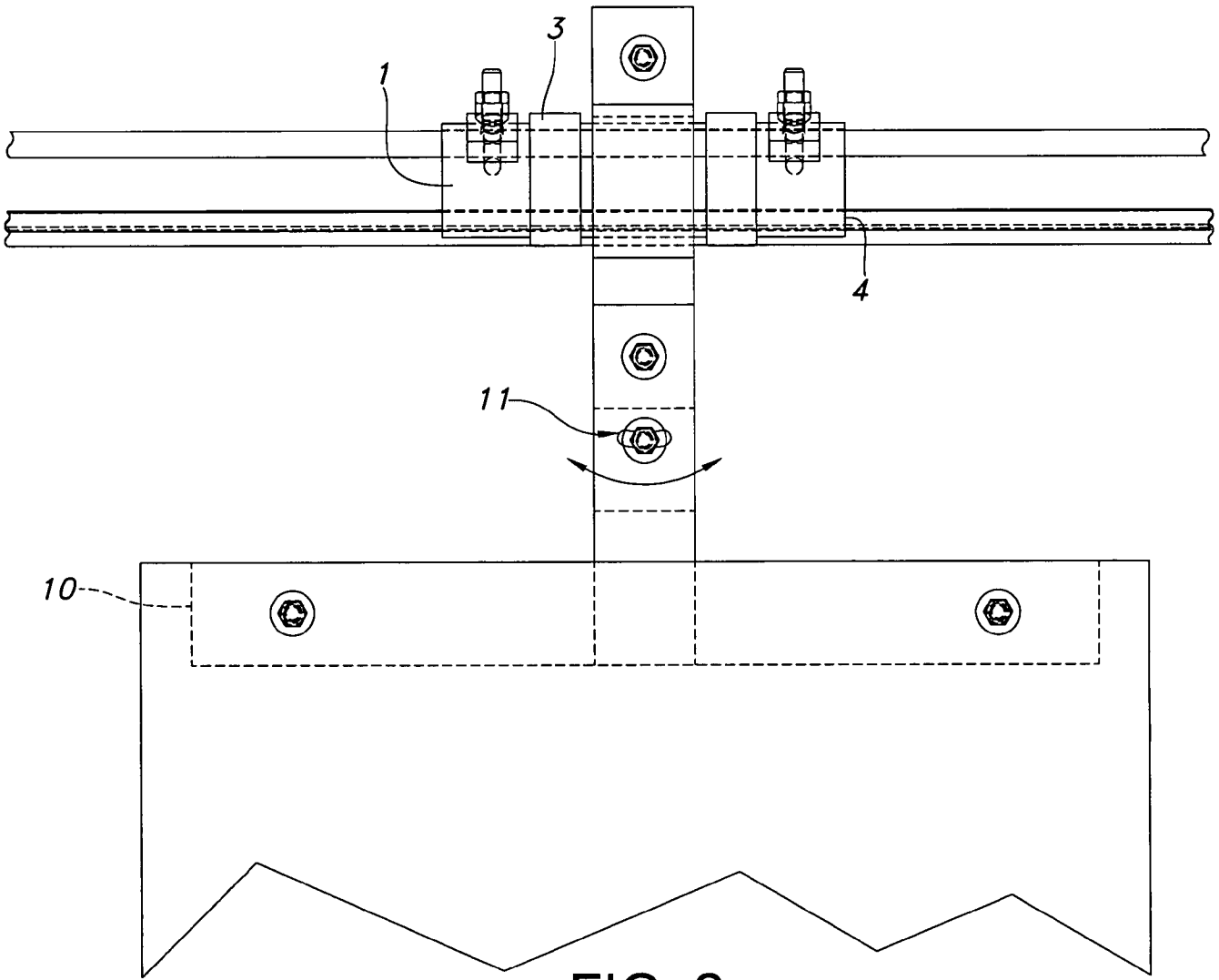
FIG. 2 is a front view of the preferred embodiment of the present invention showing its cant tilt capability.
Figure 5:
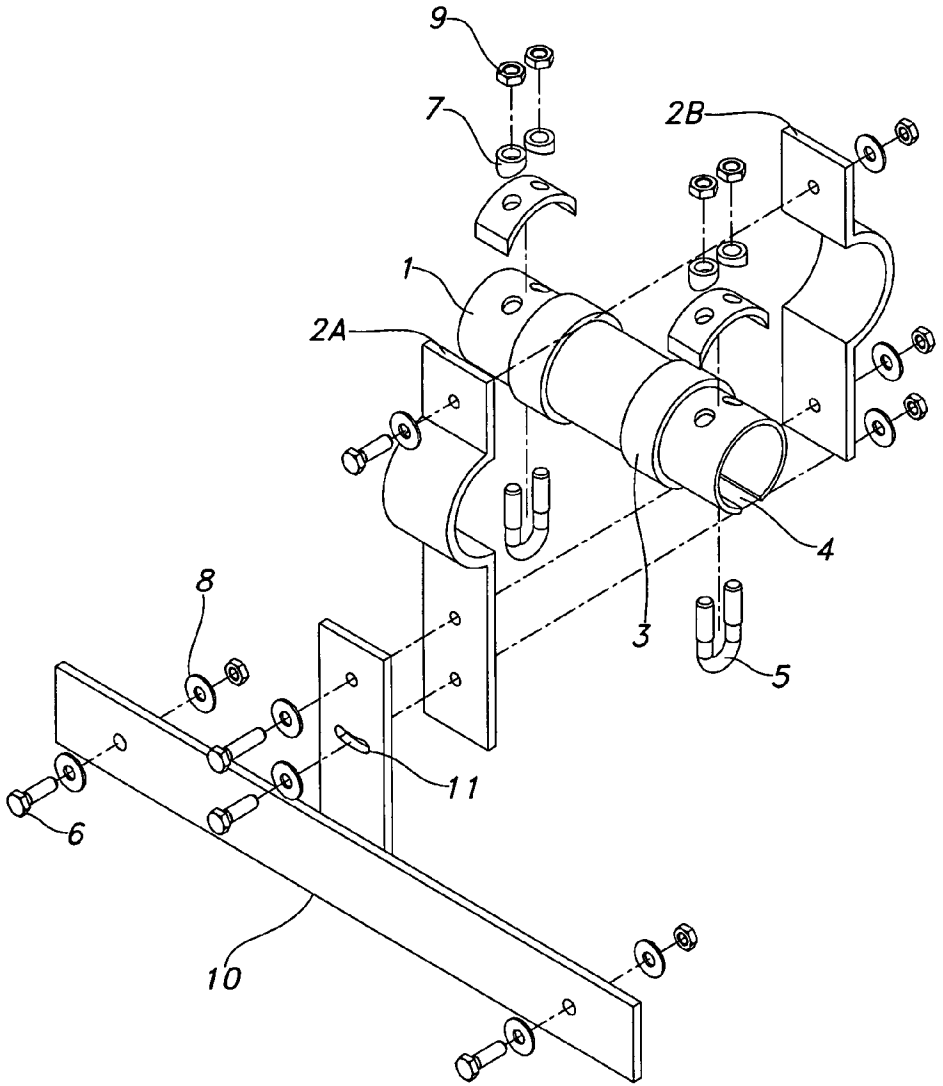
FIG. 5 is an explode view of the preferred embodiment of the present invention.

The cable saddle 1 (FIG. 1) as previously stated, is cylindrical in shape and includes two rings, guides, or pivot attachment rails 3 (FIG. 2). The pivot attachment rails 3 are raised above the contour of the cable saddle and spaced appropriately to accommodate the pivot attachment 2 when attached to the cable saddle 1. The pivot attachment rails 3 have a circular cross section and their raised edge is flat and runs parallel to the edge of the cable saddle. The cable saddle 1 also has a channel, opening or cable slot 4 (FIG. 5) dividing its lower side. Also the cable slot 4 intersects the pivot attachment rails 3. The cable slot 4 divides the full length of the cable saddle 1. I presently contemplate that the cable saddle 1 be 20 cm in length having a circular cross section of 6 mm with a diameter of 9 cm. I also contemplate that the pivot attachment rails 3 will have a circular cross section of 6 mm and be raised 6 mm above the edge of the overall body of the cable saddle 1 with a flat edge 3 cm in width that encircles the cable saddle Furthermore, I contemplate that the cable slot 4 will be 4 cm in width. Finally I contemplate that the cable saddle 1 including the pivot attachment rails 3 will be made from an investment casting using an aluminum alloy, but all aforementioned components can be of different sizes and materials, such as steel, titanium, polycarbonate, etc.

Figure 4:
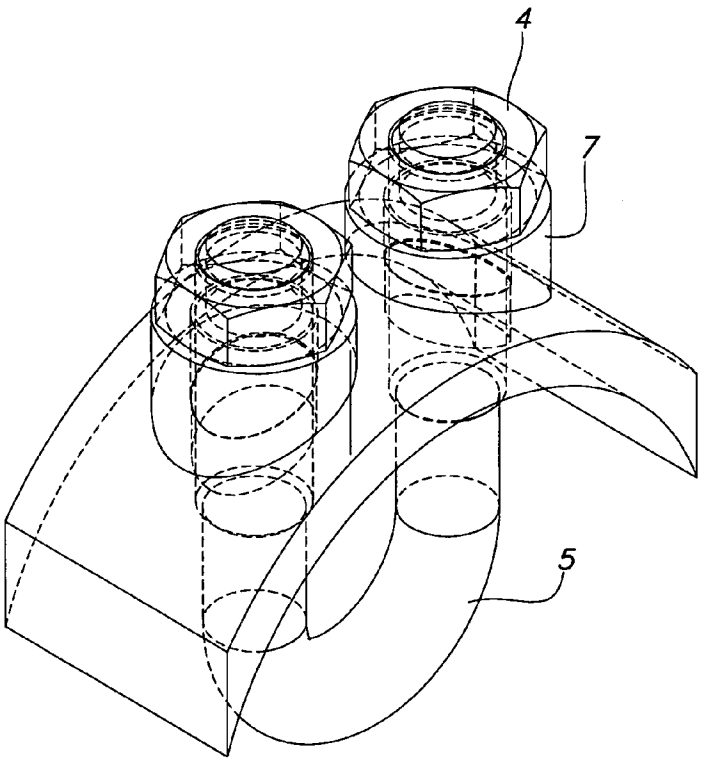
FIG. 4 is an isometric view of the saddle washer coupled with the U-bolt and lock nut of the present invention.
Figure 3:
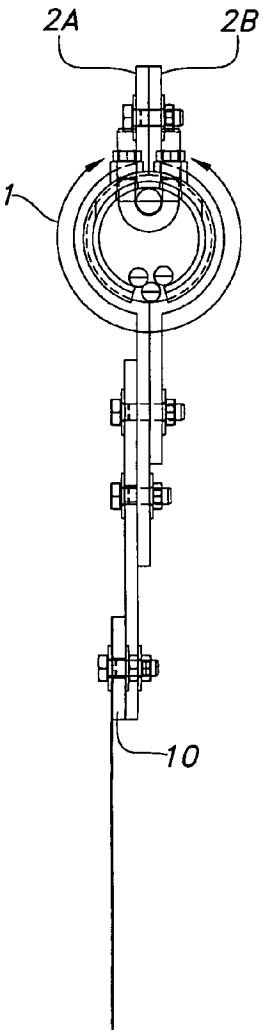
FIG. 3 is a side view of the preferred embodiment of the present invention.

FIGS. 2 and 3 show an overall side and front view of the orbital sign assembly. There are two U-bolts 5 (FIG. 4) that are threaded at both ends. The U-bolts 5 are positioned on opposite sides of the pivot attachment rails 3. The U-bolts 5 are inserted from the inside of the cable saddle 1 with the threaded ends facing outward and passing through individual openings and then mating with a saddle washer 7 and lock nut 9. The saddle washer 7 (FIG. 4) is rounded on one face allowing it to mount flush against the cable saddle 1. The opposite face of the saddle washer 7 has two raised cylindrical openings for the threaded ends of the U-bolts 5 to pass through and respectively mate with the lock nuts 9. The U-bolts 5 should be long enough to accommodate a cable, span wire or support member of a multitude of diameters. At present I contemplate the U-bolts 5 and lock nuts 9 to be made of carbon steel and the saddle washer 7 to be made of an aluminum alloy.

Referring back to the pivot attachment 2 (FIGS. 1 and 3), the pivot attachment includes two parts 2*a* and 2*b*. The pivot attachment 2*a* and 2*b* are joined at an attachment point on the top and bottom. The pivot attachment 2*a* is longer on its lower end than pivot attachment 2*b* and includes an additional attachment point for attaching the sign bracket 10. At present I contemplate that the pivot attachment 2 will have a rectangular cross section of 7 cm by 5 mm and be stamped from a piece of aluminum alloy bar stock. However it can have a different cross sections, shape, and be made a different size using different materials. I also contemplate that the length of the pivot attachment 2*a* will have a length of 15 cm from the base of the semicircle section to the bottom end and the pivot attachment 2*b* have a length of 9 cm from the base of the semicircle section to its bottom end. The attachment points of the pivot attachment 2 (FIG. 3) will be fastened using a bolt 6 washer 8 and lock nut 9. I contemplate that the sign bracket 10 could be permanently affixed to the pivot attachment 2 or various other methods could be used to respectively join the two parts together.

The sign bracket 10 (FIG. 2) is composed of a top section and a lower section. The top section adjoins at the middle of the lower section. The top section has an attachment point at its top end and a cant tilt slot 11 at its middle. The lower section has attachment points at opposite ends and may have a plurality in between, (depending on the sign to be attached.) The cant tilt slot 11 is semicircle in shape and has a radius of approximately 25 mm. I contemplate that the top section will have a rectangular cross section of 16 cm by 5 mm and the lower section 30 cm by 5 mm. The sign bracket 10 is composed of one piece which will be stamped from aluminum alloy bar stock. Furthermore it can have different cross sections, shapes, and be made a different size using different materials.

Operations—

The cable saddle 1, pivot attachment 2, and the sign bracket 10 are the key components of the orbital sign hanger. Firstly, the cable saddle 10 (FIG. 1) serves as a chassis or bearing about which the pivot attachment 2 can freely orbit. Its circular shape, when coupled with the circular opening of the pivot attachment 2, allows for seamless movement in a 360 degree range of movement. The pivot attachment 2, the sign bracket 10, and finally whatever signage that may be attached is able to rotate 360 degrees as well. The pivot attachment rails 3 (FIG. 1) limit the side to side movement of the pivot attachment and control the damage that could result if the pivot attachment 2 were allowed to move about freely. The cable slot 4 (FIG. 5) allows for various cables, including the span wire, to be inserted into the cable saddle 1 and move unrestricted in the channel through the center of the cable saddle 1. Furthermore the cable slot 4 allows for additional cables to be inserted into the cable saddle 1 even after the initial installation, without removing the cable saddle from the span wire. The U-bolts 5 (FIG. 4) fasten to a span wire or other support member giving the present embodiment rigidity yet at the same time not impeding the movement of the pivot attachment 2 and sign bracket 10. Thus, the torque and stress applied to the span wire or support member, as seen in all prior art, is virtually eliminated.

In further detail, the pivot attachment 2 (FIG. 1), acts as an arm or lever that orbits around the cable saddle. In windy conditions, like those that occur during a hurricane or tornado, the pivot attachment can orbit freely about the cable saddle 1 and between the pivot attachment rails 3. The pivot attachment 2 also provides a way of attaching the sign bracket 10 and hence any signage with the cable saddle 1.

The sign bracket 10 most importantly forms a rigid backing or plate about which the attached signage can be affixed and rest against. Secondly the cant tilt slot 11 (FIG. 2), allows for 120 degrees of adjustment from side to side which allows for leveling of various signage hung from uneven span wires or support members. Finally, the cant tilt slot 11 serves as an additional attachment point between the pivot attachment 2 and the sign bracket 10.

CONCLUSION, RAMIFICATIONS, AND SCOPE

Accordingly, the reader will see that at least one embodiment of the orbital sign assembly provides for more efficient, cost effective, and safer device that can be easily installed and maintained. Furthermore, the orbital sign assembly has the additional advantages in that

- it eliminates dangerous and costly repairs by reducing stress applied to the span wire and other cables which leads to less failures and eventual replacements;
- it uses many simple, readily available parts that are easy to identify and purchase;
- it can be adapted for use with signage of most any size and weight.

Although the above description contains many details specific to present embodiment, these should not be construed as limitations on the scope of the embodiment, but rather as an exemplification of one preferred embodiment thereof. Other variations are possible. For example, the sign bracket could be lengthened to accommodate larger signage. A different material could be used in the manufacturing—such as a polymer based material. The assembly could be made smaller to accommodate smaller signage. The sign bracket 10 and pivot attachment 2*a* could be combined and manufactured as one piece. Even the saddle washer could be combined as an integral part of the cable saddle. Accordingly, the scope of the invention should be determined not by the embodiment illustrated, but by the appended claims and their legal equivalents.

SEQUENCE LISTING

N/A

The invention claimed is:

1. An orbital sign assembly for affixing signage to a support member, comprising:

a saddle assembly comprising a first member comprising a substantially cylindrical outer surface and an open core connecting apertures at each end, a securement mechanism with at least a portion that is within the first member open core and that fixedly secures to the support member, and a second member comprising a circumferential inner surface coaxially and pivotally secured around the first member.

2. The orbital sign assembly of claim 1, wherein the saddle assembly first member further comprises at least two raised stops; wherein the saddle assembly second member is coaxially secured around the saddle assembly first member between the at least two raised stops.

3. The orbital sign assembly of claim 1, wherein the saddle assembly second member comprises two identical independent pieces; wherein each piece comprises a middle section secured between a top panel and a bottom panel, and wherein the two middle sections combine to form a hollow interior circumference larger than the saddle assembly first member outer circumference.

4. The orbital sign assembly of claim 3, wherein the independent pieces secure around the saddle by aligning the top panels and aligning the bottom panels.

5. The orbital sign assembly of claim 2, wherein the raised stops comprise rails circumferentially extending around the surface of the saddle assembly first member.

6. The orbital sign assembly of claim 1, wherein the saddle assembly first member comprises an elongated channel extending between both ends.

7. The orbital sign assembly of claim 1, wherein the cable securement mechanism receives cables extending through the length of the saddle assembly first member.

8. The orbital sign assembly of claim 1, further comprises a sign bracket secured to the saddle assembly second member, wherein the sign bracket is adapted for mounting the signage thereto.

9. A sign assembly for securing to a support member, the sign assembly comprising:

a first body comprising a substantially cylindrical outer surface and an open core, wherein the first body outer surface comprises at least two raised stops, a securement mechanism with at least a portion that is within the first body open core and that fixedly secures to the support member; and a rotatable second body coaxially and pivotally secured around the first body between the two stops, wherein the second body has a circumferential inner surface; and a sign bracket suspended from the second body.

10. The sign assembly of claim 9, wherein the first body further comprises an elongated channel extending between the two ends of the first body.

11. The sign assembly of claim 9, wherein the second body comprises two identical and independent pieces, wherein each piece comprises a semicircular surface between a top panel and a bottom panel, and wherein the two semicircular surfaces in combination define an interior circumference larger than an outer circumference of the first body.

12. The sign assembly of claim 11, wherein the independent pieces are secured with at least one fastener securing the top panels together and at least one fastener securing the bottom panels together.

13. The sign assembly of claim 9, wherein the at least two raised stops comprise rails circumferentially extending around the first body outer surface.

14. The sign assembly of claim 11, wherein the sign bracket is attached to the bottom panels with at least one fastener.

15. The sign assembly of claim 9, wherein the sign bracket comprises a vertical mounting plate secured to a horizontal mounting plate; wherein the vertical mounting plate is secured to at least one bottom panel extending from the second body, and wherein the horizontal mounting plate supports a sign.

16. The sign assembly of claim 9, further comprising a cable-containment structure.

17. The sign assembly of claim 16, wherein the cable-containment structure receive cables extending through the length of the first body open core.

18. The sign assembly of claim 16, wherein cable-containment structure comprises a pair of supports secured on either side of the length of the second body.

19. A sign assembly for securing to a support member, the sign assembly comprising:

a first member comprising a substantially cylindrical outer surface and an open core, wherein the first member outer surface comprises at least two raised stops and an elongated channel extending the length of the first member;

a securement mechanism with at least a portion that is within the first member open core and that fixedly secures to the support member;

a second member coaxially and pivotally secured around the first member between the at least two stops, wherein the second member has a circumferential inner surface; and a sign bracket secured to the second member.

* * * * *